US005555916A

United States Patent [19]

Kushida

[11] Patent Number: 5,555,916

[45] Date of Patent: Sep. 17, 1996

[54] STEEL PRODUCT EXCELLENT IN SULFIDE CRACKING RESISTANCE

[75] Inventor: Takahiro Kushida, Amagasaki, Japan

[73] Assignee: Sumitomo Metal Industries, Ltd., Osaka, Japan

[21] Appl. No.: 207,729

[22] Filed: Mar. 9, 1994

[30] Foreign Application Priority Data

Mar. 16, 1993 [JP] Japan ..... 5-81552

[51] Int. Cl.[6] ..... F16L 11/00; F16L 55/00

[52] U.S. Cl. ..... 138/177; 138/140

[58] Field of Search ..... 138/177, 140, 138/132, 133, 134, 144, 174, 178, DIG. 5; 420/99

[56] References Cited

U.S. PATENT DOCUMENTS

| | | | |
|---|---|---|---|
| 4,325,748 | 4/1982 | Nashiwa et al. . | |
| 4,402,346 | 9/1983 | Cheetham et al. | 138/133 |
| 4,472,208 | 9/1984 | Kunishige | 148/12 F |
| 4,549,581 | 10/1985 | Unno et al. | 138/174 |
| 4,729,872 | 3/1988 | Kishida et al. | 420/105 |
| 5,117,874 | 6/1992 | Ochiai et al. | 138/140 |
| 5,213,637 | 5/1993 | Herrero et al. | 148/598 |
| 5,314,549 | 5/1994 | Misao et al. | 148/325 |

FOREIGN PATENT DOCUMENTS

| | | |
|---|---|---|
| 2400067 | 3/1979 | France . |
| 54-38214 | 3/1979 | Japan . |
| 54-80226 | 6/1979 | Japan . |
| 55-113861 | 9/1980 | Japan . |
| 56-13463 | 2/1981 | Japan . |
| 56-13462 | 2/1981 | Japan . |
| 58-001014 | 1/1983 | Japan . |
| 60-213366 | 10/1985 | Japan . |
| 60-228655 | 11/1985 | Japan . |
| 62-243737 | 10/1987 | Japan . |
| 62-274049 | 11/1987 | Japan . |
| 63-134647 | 6/1988 | Japan . |
| 02185948 | 7/1990 | Japan . |
| 04120241 | 4/1992 | Japan . |

OTHER PUBLICATIONS

T. Kushida, et al., "Development of Line Pipe for Sour Service and Full Ring Test Evaluation," *The Sumitomo Search*, No. 49, pp. 64–75, Apr. 1992.

"Microscopic Testing Method for the Non–Metallic Inclusions in Steel," *JIS G 0555*, pp. 321–324 (1977).

*Primary Examiner*—David Scherbel
*Assistant Examiner*—Patrick F. Brinson
*Attorney, Agent, or Firm*—Burns, Doane, Swecker & Mathis, LLP

[57] ABSTRACT

A steel product, such as a steel pipe for line-pipe, excellent in sulfide cracking resistance sufficient to accept a CAPCIS test. The steel product is manufactured by rolling or forging to have a matrix not including B type inclusions having lengths of 200 μm or more in the longitudinal direction.

Furthermore, the steel pipe is manufactured by rolling or forging to have a matrix not including B type inclusions having dimensions of 200 μm or more in the longitudinal direction within 4 mm of the inner surface.

12 Claims, 4 Drawing Sheets

Fig. 1
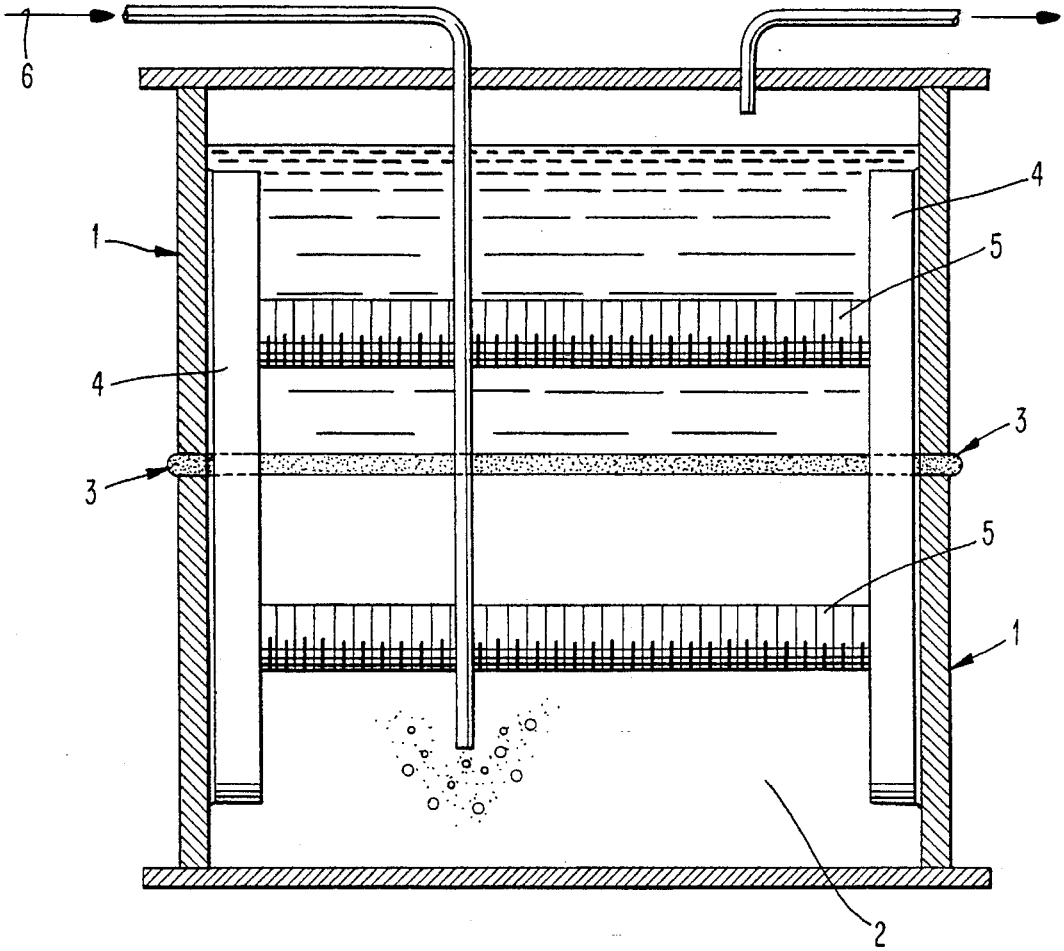
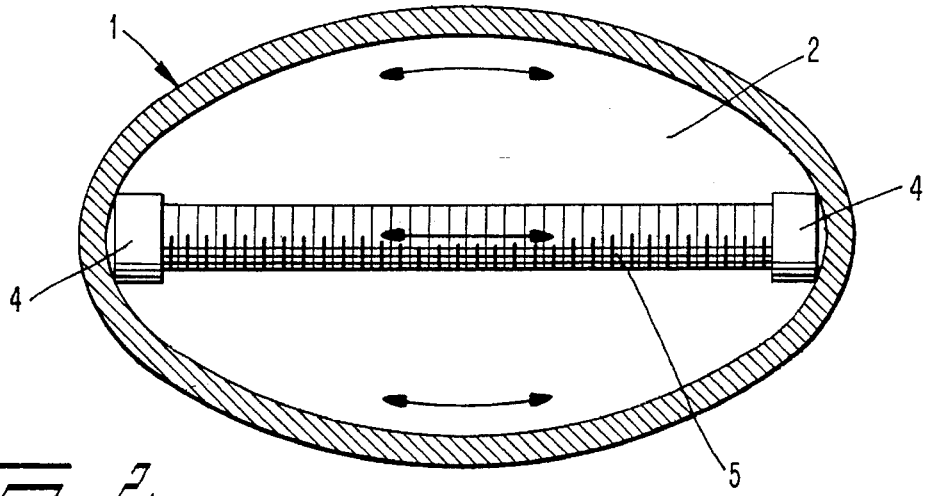
Fig. 2

THRESHOLD HYDROGEN PERMEATION COEFFICIENT FOR HIC (μA/cm)
70
60
50
40
30
20
10
0
LENGTH OF B TYPE INCLUSION IN ROLLING AXIAL DIRECTION (μm)
0
200
400
600
23
24
25
26
27

STEEL PRODUCT EXCELLENT IN SULFIDE CRACKING RESISTANCE

BACKGROUND OF THE INVENTION

1. Field of the Invention

The present invention relates to steel products, such as plates and pipes excellent in sulfide cracking resistance and suitable as component members of vessels, reactors and line-pipes for storing, refining or transporting crude oil or gas containing hydrogen sulfide.

2. Description of the Related Art

As is well known, hydrogen induced cracking (HIC) or sulfide stress cracking (SSC), hereinafter collectively referred to as "sulfide cracking", is a serious problem with steel plates and pipes used for oil tankers, reactors and vessels, or with line-pipes and oil-country-tubular-goods (OCTG) for crude oil or gas containing hydrogen sulfide.

HIC is generated under no external stress, whereas SSC is generated under static stress. This sulfide cracking is one of the embrittling phenomena that affect steel, that is, hydrogen embrittlement occurs due to the absorption of the hydrogen produced when steel is corroded in a wet hydrogen sulfide environment.

On the basis of studies of sulfide cracking, many counter measures have been proposed:

a) The absorption of hydrogen into steel in a wet hydrogen sulfide environment is suppressed by the addition of copper, thus improving HIC and SSC resistance.

b) Since HIC occurs where sharp edges of A type inclusions composed of MnS are taken as the initiation sites, the sharp edges of the inclusions are eliminated by the addition of calcium, thereby controlling the morphology of sulfides.

c) The number of inclusions is reduced and the shape of sulfide is controlled by the addition of calcium (disclosed in Unexamined Japanese Patent Publication No. SHO 56-13463).

d) Since susceptibility to HIC and SSC is increased by the formation of a hardened structure at the center segregation with high concentrations of manganese and phosphorus, the segregation is reduced by soaking diffusion, or the formation of the hardened structure is prevented by accelerated cooling after rolling.

With these measures, in small scale laboratory tests using small-size specimens which are immersed in what is called a NACE solution "0.5% $CH_3COOH$+5% NaCl, saturated with $H_2S$ at 1 atm, 25° C.", the HIC resistance could be significantly reduced.

Steel products used in the above-mentioned environments must satisfy the requirement that the crack length ratio (CLR) after being immersed in the NACE solution for 96 hrs is less than 15%, or even less than 5%.

In recent years, however, oil wells and gas wells have been developed in more severe environments. From the view point of economy, the strength of steel products becomes more important and the operational pressure increases. The service environments for steel products, especially steel pipes is becoming more hostile.

Taking the above circumstances into consideration, a full ring test is often used to evaluate HIC resistance and SSC resistance, in addition to the conventional small-size laboratory test.

The full ring test is represented by a "CAPCIS type full ring test".

As shown in FIG. 1 and FIG. 2, respectively a vertical sectional view and a top view explaining the state where stress is applied in the CAPCIS type full ring test, a short-size steel pipe (full ring pipe) is expanded from inside to apply a tensile strength by bending the inner surface. In this state, the steel pipe 1 is filled with a NACE solution 2(NACE TM-01-77 bath with 0.5% $CH_3COOH$+5% NaCl solution) to thus evaluate the occurrence of HIC and SSC. This method, wherein the pipe 1 includes peripheral welding 3 and supporting bars 4 are located inside the pipe and pushed apart by jack screws 5 while gas 6 ($H_2S$ at 1 atm) is injected into the solution, is relatively simple and suitable to evaluate the actual pipe, and therefore, it tends to be widely used.

This testing method is performed in a state where the residual stress upon the pipe-making process remains. It gives a very severe evaluation compared with the conventional small-size laboratory test in which the residual stress of the specimen is almost released after cutting.

However, steel pipes having sulfide cracking resistance sufficient to accept the CAPCIS type full ring test have not been developed.

SUMMARY OF THE INVENTION

An object of the present invention is to provide steel pipes having a high level of sulfide cracking resistance, sufficient to accept the CAPCIS type full ring test, and other steel products with superior sulfide cracking resistance equivalent to the above-described steel pipes.

To achieve the above object, according to a first aspect of the present invention, there is provided a steel product excellent in sulfide cracking resistance which is manufactured by rolling or forging, characterized in that a matrix does not substantially contain B type inclusions having lengths of 200 μm or more in the longitudinal direction.

The above B type inclusions are formed by granular inclusions discontinuously and collectively disposed in the working direction.

The above steel product is preferably manufactured using a steel material containing 0.01–0.20 wt % of carbon, 0.01–0.5 wt % of silicon, 0.3–1.8 wt % of manganese, 0.01–0.1 wt % of aluminum, 0.012 wt % or less of phosphorus, and 0.002 wt % or less of sulfur, the remainder being substantially iron and inevitable impurities, wherein the calcium/sulfur ratio (hereinafter, referred as Ca/S ratio) is in the range of 2–10.

Furthermore, a structure for processing crude oil or gas containing hydrogen sulfide may be made of the above steel product.

In a second aspect of the present invention, there is provided a steel pipe excellent in sulfide cracking resistance which is manufactured by rolling or forging, characterized in that the matrix does not substantially contain B type inclusions having lengths of 200 μm or more in the longitudinal direction, within 4 mm from the inner surface.

The above B type inclusions are formed by granular inclusions discontinuously and collectively disposed in the working direction.

The above steel pipe is preferably manufactured by a steel material containing 0.01–0.20 wt % of carbon, 0.01–0.5 wt % of silicon, 0.3–1.8 wt % of manganese, 0.01–0.1 wt % of aluminum, 0.012 wt % or less of phosphorus, and 0.002 wt % or less of sulfur, the remainder being substantially iron and inevitable impurities, wherein the Ca/S ratio is in the range of 2–10.

Furthermore, a line-pipe for transporting crude oil or gas containing hydrogen sulfide may be made of the above steel pipe.

BRIEF DESCRIPTION OF THE DRAWINGS

FIG. 1 is a vertical sectional view for explaining a CAPCIS type full ring test;

FIG. 2 is a top view of the CAPCIS type full ring test showing the state in which stress is applied;

DETAILED DESCRIPTION OF THE PREFERRED EMBODIMENTS

Figure 3:
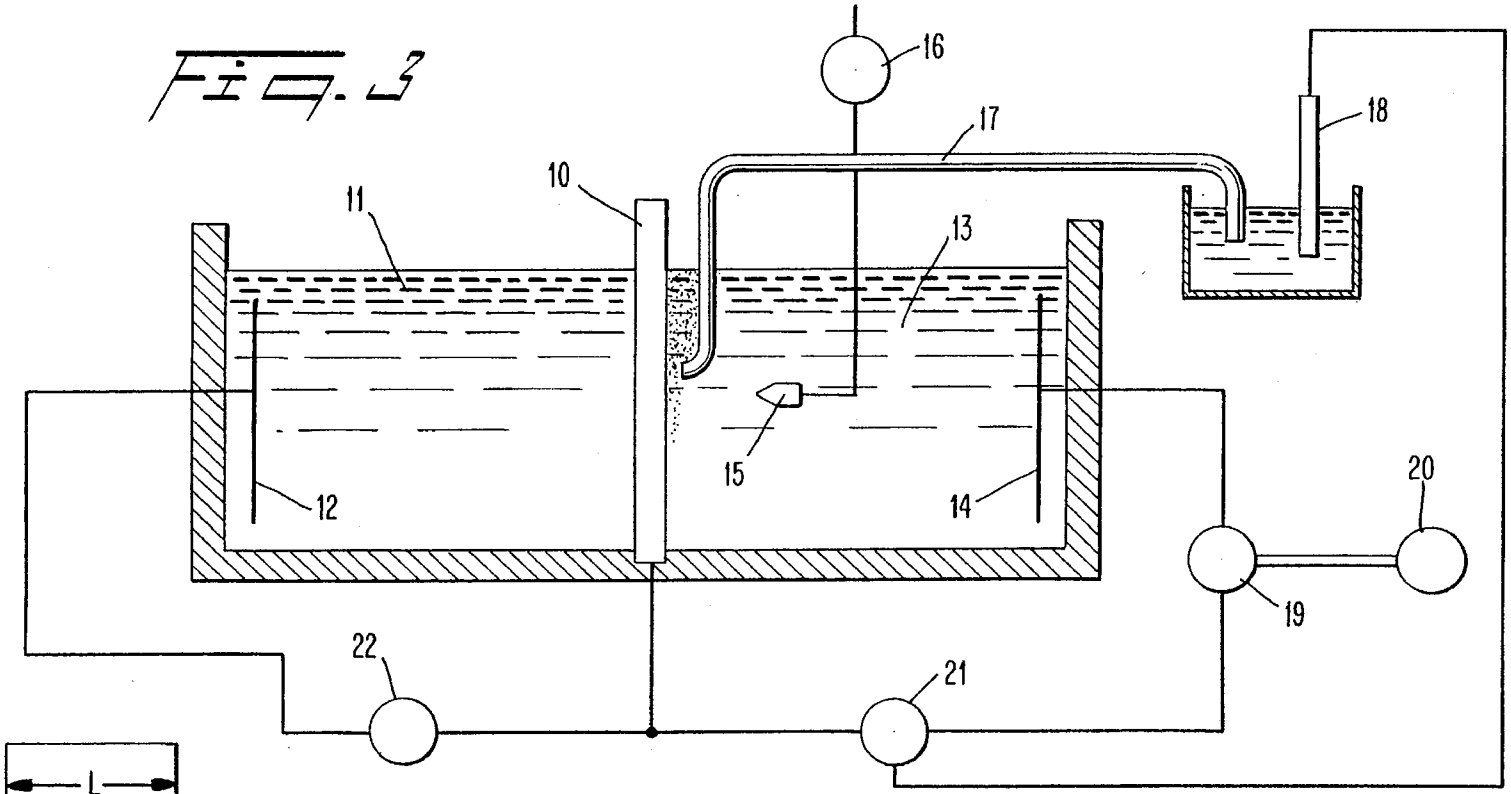
FIG. 3 is a view for explaining an HIC in-situ measurement method for qualifying the HIC resistance of a small-size specimen under no stress.

Hereinafter, embodiments of the present invention will be described with reference to the drawings.

The present inventor has conducted research to create steel products, especially steel pipes of superior sulfide cracking resistance sufficient to accept a CAPCIS type full ring test. In the course of research, the inventor has evaluated BSC resistance for line pipe materials ranging from X52 grade to X65 grade (API Specification, classified by strength (ksi)) by the CAPCIS type full ring test shown in FIGS. 1 and 2, and has fully investigated the initiation sites of SSC. As a result, the following knowledge has been obtained.

a) Any SSC exhibits the morphology wherein cracks due to HIC occurred parallel to the stress axis are stepwise connected to each other.

b) Each crack due to HIC occurs because of the B type inclusion.

c) On the HIC fracture surface, the length of the B type inclusion in the longitudinal direction is 200 μm or more.

d) When only the inner surface of the pipe is exposed to a NACE solution as in the CAPCIS test, SSC occurs only within the range of 4 mm or less from the inner surface.

From the above-described knowledge, the sulfide cracking resistance in the full ring test is considered to be deteriorated by B type inclusions having lengths of 200 μm or more in the longitudinal direction.

Next, the present inventor examined the effect of the lengths of the B type inclusions, which produced the following results.

As the lengths of the B type inclusions become longer, HIC is caused by less hydrogen. Accordingly, HIC susceptibility can be discussed on the basis of the lengths of the B type inclusions. In addition, since steel products, especially steel pipes used for line-pipe, are usually manufactured by rolling or forging, the B type inclusions are extended in the rolling direction or forging axial direction, that is to say the longitudinal direction. Consequently, "the length of the B type inclusion" described above means "the length in the longitudinal direction ".

The cracking almost always occurs when the lengths of the B type inclusions are 250 μm or more under no stress, and when the lengths of the B type inclusions are 200 μm or more under stress. Accordingly, the 200 μm length of B type inclusion is the critical length for SSC resistance.

If only one side is exposed to a liquid or gas containing hydrogen sulfide, the B type inclusions of 200 μm or more exert an effect on the sulfide cracking only if said B type inclusions are within 4 mm of the surface exposed to the liquid or gas containing hydrogen sulfide. In particular, for the steel pipes of a line-pipe, since only the inner surface is exposed to a liquid or gas containing hydrogen sulfide, only the inclusions that are within 4 mm or less from the inner surface exert an effect on the SSC resistance. Additionally, if both surfaces of a steel product have contact with a liquid or gas containing hydrogen sulfide, the inclusions in the center portion of the wall width cause a problem, which will be described later.

The present invention is accomplished on the basis of the above-described knowledge, and is characterized in that a steel product is manufactured by rolling or forging to have a matrix not containing B type inclusions having lengths of 200 μm or more in the longitudinal direction, thereby providing a steel product with superior sulfide cracking resistance; or in that a steel pipe is manufactured by rolling or forging to have a matrix not containing B type inclusions having lengths of 200 μm or more within 4 mm of the inner surface, thereby providing a steel pipe of superior sulfide cracking resistance.

The wording "B type inclusions" means "inclusions formed by granular inclusions discontinuously and collectively disposed in the working direction (alumina, etc.)" as specified in JIB G 0555 or in ASTM E 25-87.

Steel products, especially steel pipes of the present invention are used for applications where sulfide cracking is at stake, for example, line-pipes, tankers, vessels and reactors. In this regard, steel products, especially steel pipes of the present invention, basically contain carbon of 0.01–0.20 wt %, preferably, 0.03–0.18 wt % (hereinafter, simply referred to as "%"), silicon of 0.01–0.5%, preferably, 0.1–0.3%, manganese of 0.3–1.8%, preferably, 0.5–1.5%, phosphorus of 0.012% or less, sulfur of 0.002% or less, and aluminum of 0.01–0.1%, preferably 0.01–0.05%, wherein the Ca/S ratio is preferably adjusted to be in the range of 2–10.

In the above composition, each component has the following effect.

Carbon is a strengthening element of steel. To obtain the necessary strength for steel, it is added in an amount of 0.01% or more. To suppress weld cracking, the carbon content is in the range of 0.20% or less.

Silicon functions as an oxidizing agent in steel-making, and is added in an amount of 0.01% or more. To prevent the deterioration of the toughness of steel, the silicon content is suppressed to be 0.5% or less.

Manganese is also effective to ensure the strength of steel. To obtain the necessary strength for steel, it is added in an amount of 0.3% or more. To suppress weld cracking and to prevent the sulfide cracking, the manganese content is in the range of 1.8% or less.

Phosphorus is susceptible to center segregation and forms an abnormal structure due to the segregation in concentration together with manganese, thus decreasing HIC resistance. The phosphorus content is suppressed to 0.012% or less.

Sulfur forms MnS at the center segregation portion in the slab or the ingot even if the shapes of sulfides are controlled by the addition of calcium, and deteriorates HIC resistance. The sulfur content is suppressed to 0.002% or less. In addition, calcium is effective to control the shape of sulfide inclusions. To ensure the desirable HIC resistance by shape control, the Ca/S ratio is preferably adjusted to be in the range of 2–10.

Aluminum is an oxidizing agent, and is added in an amount of 0.01% or more. To keep the steel clean and to prevent deterioration of the toughness of the steel, the aluminum content is preferably in the range of 0.1% or less.

Other elements such as copper, nickel, titanium, niobium and vanadium, may be contained in amounts that improve corrosion resistance or mechanical properties of the steel products of this invention.

As described above, in the course of studying steel products capable of stably achieving superior sulfide cracking resistance, it was seen that B type inclusions having lengths of 200 μm or more in the longitudinal direction deteriorated the BSC resistance, particularly, for the steel pipes in the full ring test, when within 4 mm of the inner surface of the steel pipes. Accordingly, the present inventor has fully examined the effects of the lengths of the B type inclusions.

In this examination, a "HIC-in situ measuring method" newly designed by the present inventor was used. The outline of this measuring method is shown in FIG. 3.

The HIC-in situ measuring method is intended to examine the occurrence of HIC by a method wherein hydrogen is charged from one side of a specimen 10, similar to a full ring test with no stress, and the amount of hydrogen diffused from the opposing surface of the specimen is electrochemically measured. This method wherein the specimen 10 is between cathode bath 11 having Pt counter electrode 12 and anode bath 13 having Pt counter electrode 14 and the arrangement includes probe 15 connected to scanner 16, salt bridge 17, reference electrode 18, ammeter 19, recorder 20, potentiostat 21 and galvanometer 22, can measure the threshold hydrogen permeation coefficient for HIC by stepwisely increasing the amount of hydrogen charged until HIC occurs.

The threshold hydrogen permeation coefficient is a value (μA/cm) obtained by multiplying the threshold hydrogen permeation rate (μA/cm$^2$) by the cracking depth (cm) from the surface. This is converted into hydrogen concentration by being divided by a hydrogen diffusion coefficient in steel.

The lengths of the B type inclusions in the longitudinal direction on the HIC fracture surface, on which the threshold hydrogen permeation coefficient for HIC is quantified by the above means, are also measured. The relationship between the lengths of B type inclusions and the threshold hydrogen permeation coefficient for HIC is summarized and plotted in FIG. 4 wherein 23 shows the influence of tensile stress, 24 shows the minimum inclusion length as starting point of SSC generated by the CAPCIS type full ring test, 25 represents the maximum hydrogen permeability coefficient possibly obtained by the CAPCIS type full ring test, 26 represents a condition under no stress and 27 represents a condition under stress (72% SMYS).

As is apparent from this figure, as the length of the B type inclusion becomes longer, the threshold hydrogen permeation coefficient for HIC decreases. Namely, as the length of the B type inclusion becomes longer, HIC is caused by less hydrogen. Therefore, for convenience, the HIC sensitivity can be discussed on the basis of the length of the B type inclusion.

Figure 5:
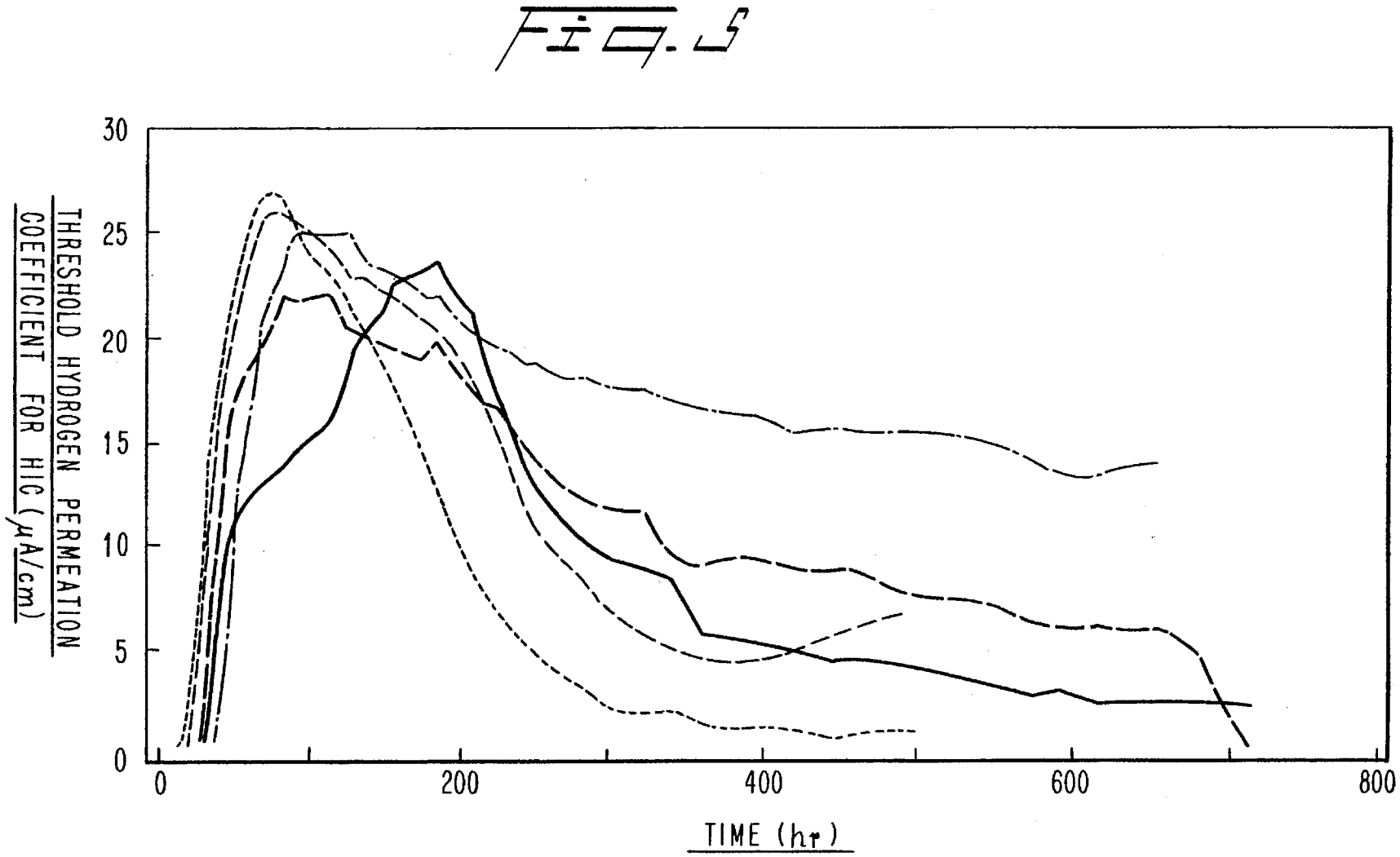
FIG. 5 is a graph showing the change in the surface hydrogen permeation coefficient with time in the CAPCIS type full ring test.

FIG. 5 shows the change in the threshold hydrogen permeation coefficient for HIC with time in the CAPCIS test. As shown in this figure, in the CAPCIS type full ring test using a NACE solution, the maximum value of the surface threshold hydrogen permeation coefficient for HIC is in the range of more than 25 μA/cm to less than 30 μA/cm.

Figure 4:
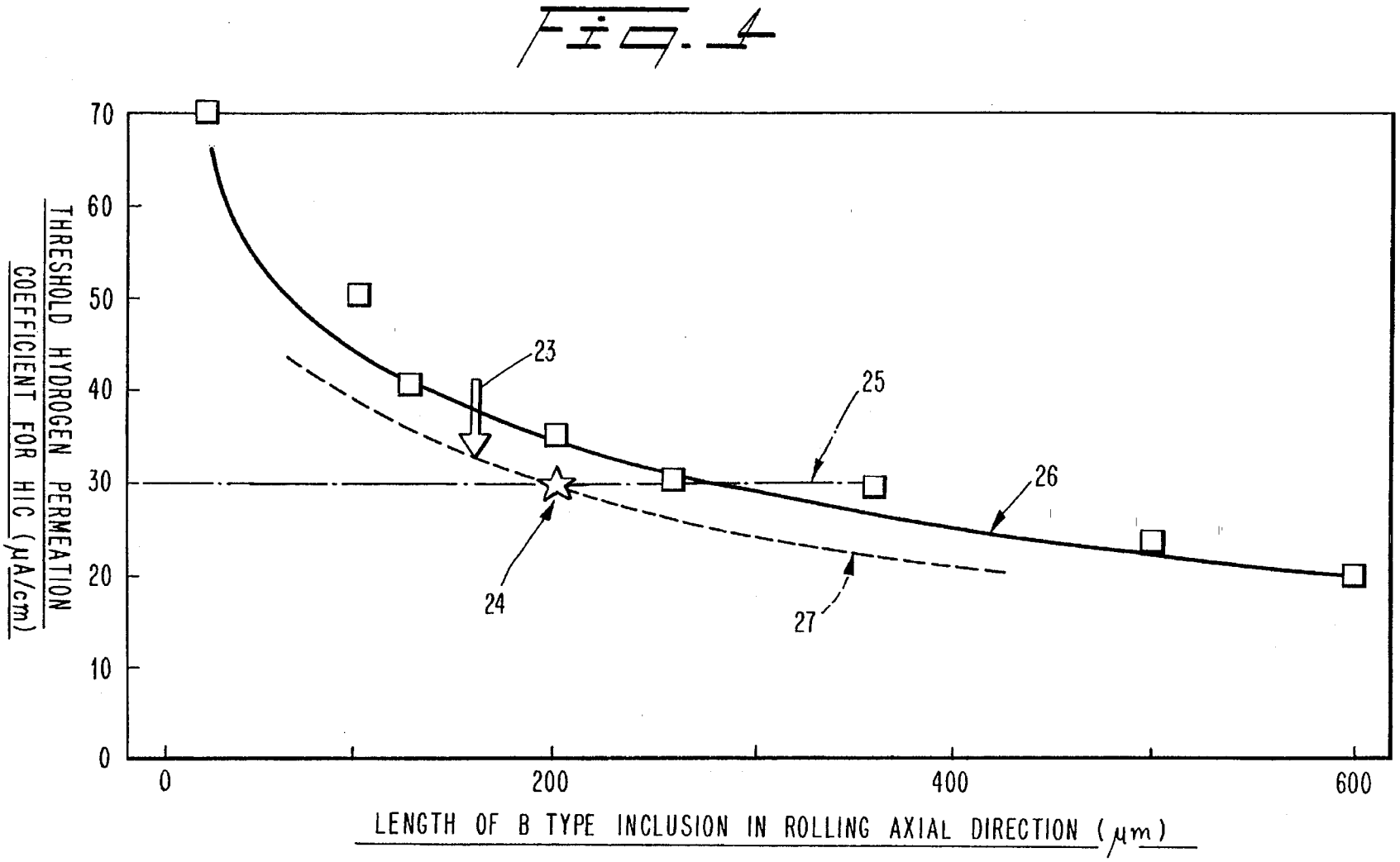
FIG. 4 is a graph showing a correlation between the length of B type inclusion in the longitudinal direction and the threshold hydrogen permeation coefficient for crack.

Accordingly, the surface threshold hydrogen permeation coefficient for HIC in the CAPCIS type full ring test is judged to be 30 μA/cm at maximum, and, as is apparent from FIG. 4, the B type inclusions having lengths of 250 μm or more cause cracking of steel under no stress.

However, as per results of various CAPCIS full ring tests using test pieces having various chemical compositions, if 72% of the specified minimum yield stress (SMYS) is applied, HIC occurs even for B type inclusions having lengths of 200 μm. Furthermore, stress accelerates HIC and SSC. Taking these results into consideration, it can be confirmed that B type inclusions having lengths of 200 μm or more in the longitudinal direction deteriorate SSC resistance in the full ring test. This indicates that sufficient sulfide cracking resistance can be achieved by removing B type inclusions having lengths of 200 μm or more in the rolling direction. For forged steel products, sufficient sulfide cracking resistance cannot be ensured unless B type inclusions having lengths of 200 μm or more in the forging axial direction are eliminated.

As described above, when the lengths of B type inclusions in the longitudinal direction exceed the upper limit of 200 μm, HIC is generated under stress, and the B type inclusions are taken as the initiation sites. The cracks due to HIC are connected to each other, and cause SSC, thus deteriorating the BSC resistance in the full ring test. Accordingly, although the present invention restricts the steel product to having a matrix not including B type inclusions with lengths of 200 μm or more in the longitudinal direction, it would be best to eliminate B type inclusions having lengths of 100 μm or more.

Figure 6:
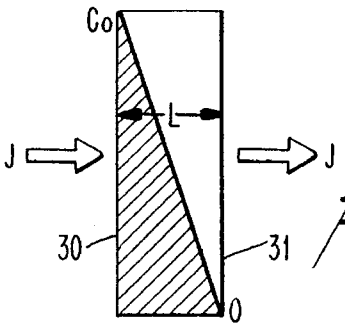
FIG. 6 is a typical view showing the hydrogen concentration distribution in the wall thickness direction when only one side of a steel product is exposed to a corrosive fluid.
Figure 7:
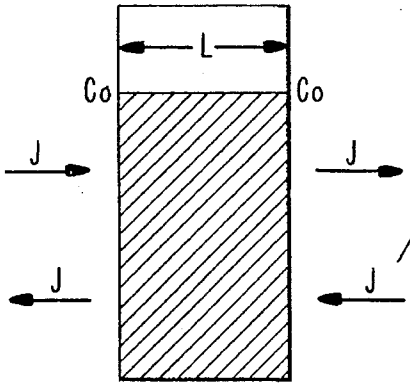
FIG. 7 is a typical view showing the hydrogen concentration distribution in the wall thickness direction when both sides of a steel product are exposed to a corrosive fluid.

However, in the case of a steel pipe where only one surface has contact with a corrosive fluid, for example, in a pipe line where the interior permits the flow of a corrosive fluid and the outer surface is exposed to the atmospheric environment, the hydrogen concentration gradient in steel is as shown in FIG. 6 wherein 30 represents the inner surface and 31 represents the outer surface and Co=

$$\left(\frac{J \times L}{D}\right) \times (1.318)$$

wherein Co is the surface concentration (ppm), J is the hydrogen permeable rate (A/cm$^2$), L is the plate thickness (cm), D is the hydrogen diffusion coefficient in steel (cm$^2$/s) and J×L is the threshold hydrogen permeation coefficient for HIC (A/cm). In this case, as long as B type inclusions having the above-described lengths are not present within the vicinity of the inner surface where the hydrogen concentration is high, there is no problem of the inclusions causing sulfide cracking. As the result of various examinations, it has been revealed that B type inclusions located at areas 4 mm or farther from the inner surface do not act as the initiation sites of HIC, because the hydrogen concentration in this area is significantly reduced when compared with the inner surface. Therefore, the present invention restricts the steel pipe to having a matrix not including B type inclusions having lengths of 200 μm or more in the longitudinal direction within 4 mm of the inner surface.

Where both sides have contact with a corrosive fluid, as shown in FIG. 7, the hydrogen concentration in steel becomes uniform in the wall thickness direction. Accordingly, the steel product used in such an environment must not contain B type inclusions having lengths of 200 μm or more anywhere throughout the entire wall thickness.

The steel products, especially steel pipes according to the present invention, can be manufactured by the combination of the following means of:

a) throughly removing non-metallic inclusions such as CaO, CaB, $Al_2O_3$ remaining in deoxidization and/or desulfurization of steel or the addition of Ca to steel; and b) rolling or forging at a lower reduction ratio.

Preferably, the states of inclusions are previously examined for each kind or dimension of steel product, and the manufacturing condition may be adjusted on the basis of the results of the examination.

In a steel plate made of a slab manufactured in a bending-type continuous casting process, inclusions accumulate in the upper side of the plate thickness. Therefore, the pipe-making process should be performed so that the upper side of the plate is located on the outer side of the pipe.

The present invention will be more clearly understood with reference to the following examples.

First, the steel pipes (outside diameter: 1609.6 mm, wall thickness: 25.4 mm) shown in Table 1 were prepared. Each steel pipe was filled with the NACE solution, and was expanded by jacking up to 72% of the specified minimum yield stress (SMYS) applied at the maximum position of stress, thus carrying out the CAPCIS type full ring test.

In this test, the occurrence of HIC was examined. At this time, the specimen in which SSC was generated was further examined to find the minimum length in the longitudinal direction on the fracture surface, and the maximum depth of the crack-existing area from the surface.

The results are shown in Table 1.

Referring to Table 1, as a result of the CAPCIS type full ring test in which the steel pipe was filled with the NACE solution and was expanded by jacking up to 72% of the specified minimum yield stress (SMYS) applied at the maximum position of stress, B type inclusions having lengths of at least 200 μm were observed on the fracture surface of the steel pipe in which SSC was generated.

To examine the meaning of the above-described "B type inclusions having lengths of 200 μm", for the steel pipes (except for steel pipe No.10) shown in Table 1 added to five new kinds of steel pipes (same dimension), B type inclusions present within 4 mm of the inner surface of each steel pipe were examined according to JIB G 0555. The maximum length of the B type inclusions in the longitudinal direction were then measured. Thereafter, the CAPCIS full ring test was carried out under the same conditions as described above, to examine the occurrence of SSC.

The results are shown in Table 2.

As is apparent from the above results, any steel pipe of the present invention, in which B type inclusions are present within 4 mm of the inner surface, but the maximum length in the longitudinal direction is 200 μm or less, do not cause any SSC in the CAPCIS full ring test. On the other hand, the steel pipe containing B type inclusions having lengths of 200 μm or more caused SSC.

Additionally, steel plates with a thickness of 25.4 mm shown in Table 3 were prepared. These steel plates were first examined for B type inclusions present in the range of the full wall thickness according to JIS G 0555. The maximum length in the longitudinal direction was then measured and, thereafter, each steel plate was subjected to the HIC test in the NACE solution, to examine the occurrence of HIC.

The results are shown in Table 3.

As is apparent from the above results, in any steel plate of the present invention which does not contain B type inclusions having a maximum length of more than 200 μm in the longitudinal direction no HIC occurred. On the other hand, the plates containing B type inclusions having a maximum length of 200 μm or more caused HIC.

As described above, the present invention provides steel products, especially steel pipes, capable of stably achieving superior sulfide cracking resistance sufficient to prevent the generation of HIC or SSC even in a NACE solution. Therefore, the present invention contributes to the improved performance of OCTG and pipe lines for transporting crude oil or gas containing hydrogen sulfide and reactors or vessels for crude oil or gas containing hydrogen sulfide.

TABLE 1

| kind of steel pipe | strength level (API Spec.) | kind of steel | chemical composition (wt %. bal.: Fe and impurities) C | Si | Mn | P | S | Al | Ca | others | SSC | length (μm) of minimum B type inclusion as initiation site of crack | minimum depth (mm) of crack-existing area |
|---|---|---|---|---|---|---|---|---|---|---|---|---|---|
| 1 | X65 | A | 0.05 | 0.19 | 1.26 | 0.009 | 0.0008 | 0.028 | 0.0035 | Cu:0.25, Ni:0.06 Nb:0.03, V:0.05 Ti:0.02 | occurred | 250 | 2.8 |
| 2 | X65 | B | 0.06 | 0.20 | 1.28 | 0.008 | 0.0009 | 0.032 | 0.0055 | Cu:0.24, Ni:0.05 Nb:0.02, V:0.05 Ti:0.03 | occurred | 400 | 3.5 |
| 3 | X65 | C | 0.05 | 0.21 | 0.26 | 0.009 | 0.0008 | 0.035 | 0.0035 | Cu:0.26, Ni:0.04 Nb:0.04, V:0.04 Ti:0.02 | not occurred | — | — |
| 4 | X60 | D | 0.09 | 0.25 | 1.02 | 0.011 | 0.0007 | 0.026 | 0.0025 | Nb:0.04, V:0.04 Ti:0.02 | occurred | 600 | 3.9 |
| 5 | X60 | E | 0.09 | 0.24 | 0.99 | 0.010 | 0.0008 | 0.024 | 0.0036 | Nb:0.04, V:0.06 Ti:0.03 | occurred | 200 | 2.5 |
| 6 | X60 | F | 0.09 | 0.25 | 1.02 | 0.011 | 0.0007 | 0.026 | 0.0025 | Nb:0.03, V:0.05 Ti:0.03 | not occurred | — | — |

TABLE 1-continued

| kind of steel pipe | strength level (API Spec.) | kind of steel | chemical composition (wt %. bal.: Fe and impurities) C | Si | Mn | P | S | Al | Ca | others | SSC | length (μm) of minimum B type inclusion as initiation site of crack | minimum depth (mm) of crack-existing area |
|---|---|---|---|---|---|---|---|---|---|---|---|---|---|
| 7 | X56 | G | 0.08 | 0.34 | 0.81 | 0.008 | 0.0006 | 0.041 | 0.0044 | Nb:0.05, Ti:0.02 | occurred | 500 | 3.3 |
| 8 | X56 | H | 0.08 | 0.35 | 0.82 | 0.009 | 0.0008 | 0.036 | 0.0039 | Nb:0.04, Ti:0.03 | not occurred | — | — |
| 9 | X52 | I | 0.06 | 0.22 | 0.71 | 0.010 | 0.0011 | 0.036 | 0.0064 | Cu:0.23, Nb:0.02 | occurred | 300 | 3.0 |
| 10 | X52 | J | 0.06 | 0.22 | 0.69 | 0.011 | 0.0010 | 0.036 | 0.0050 | Cu:0.25, Nb:0.03 | occurred | 240 | 3.0 |

TABLE 2

| kind of steel pipe | | strength level (API Spec.) | kind of steel | chemical composition (wt %, bal.: Fe and impurities) C | Si | Mn | P | S | Al | Ca | others | length (μm) of maximum B type inclusion* | SSC |
|---|---|---|---|---|---|---|---|---|---|---|---|---|---|
| comparative example | 1 | X65 | A | 0.05 | 0.19 | 1.26 | 0.009 | 0.0008 | 0.028 | 0.0035 | Cu:0.25, Ni:0.06 Nb:0.03, V:0.05 Ti:0.02 | 300 | occurred |
| | 2 | X65 | B | 0.06 | 0.20 | 1.28 | 0.008 | 0.0009 | 0.032 | 0.0055 | Cu:0.24, Ni:0.05 Nb:0.02, V:0.05 Ti:0.03 | 500 | occurred |
| inventive example | 3 | X65 | C | 0.05 | 0.21 | 1.26 | 0.009 | 0.0008 | 0.035 | 0.0035 | Cu:0.26, Ni:0.04 Nb:0.04, V:0.04 Ti:0.02 | 150 | not occurred |
| comparative example | 4 | X60 | D | 0.09 | 0.25 | 1.02 | 0.011 | 0.0007 | 0.026 | 0.0025 | Nb:0.04, V:0.04 Ti:0.02 | 1000 | occurred |
| | 5 | X60 | E | 0.09 | 0.24 | 0.99 | 0.010 | 0.0008 | 0.024 | 0.0036 | Nb:0.04, V:0.06 Ti:0.03 | 250 | occurred |
| inventive example | 6 | X60 | F | 0.09 | 0.25 | 1.02 | 0.011 | 0.0007 | 0.026 | 0.0025 | Nb:0.03, V:0.05 Ti:0.03 | 180 | not occurred |
| comparative ex. | 7 | X56 | G | 0.08 | 0.34 | 0.81 | 0.008 | 0.0006 | 0.041 | 0.0044 | Nb:0.05, Ti:0.02 | 600 | occurred |
| inventive ex | 8 | X56 | H | 0.08 | 0.35 | 0.82 | 0.009 | 0.0008 | 0.036 | 0.0039 | Nb:0.04, Ti:0.03 | 100 | not occurred |
| comparative ex. | 9 | X52 | I | 0.06 | 0.22 | 0.71 | 0.010 | 0.0011 | 0.036 | 0.0064 | Cu:0.23, Nb:0.02 | 300 | occurred |
| inventive | 11 | X52 | K | 0.06 | 0.22 | 0.73 | 0.009 | 0.0010 | 0.034 | 0.0045 | Cu:0.25, Nb:0.03 | 120 | not occurred |
| example | 12 | X65 | L | 0.04 | 0.15 | 1.35 | 0.007 | 0.0007 | 0.025 | 0.0021 | — | 80 | not occurred |
| | 13 | X60 | M | 0.07 | 0.22 | 1.20 | 0.009 | 0.0010 | 0.029 | 0.0032 | — | 100 | not occurred |
| | 14 | X56 | N | 0.09 | 0.26 | 0.95 | 0.008 | 0.0006 | 0.024 | 0.0024 | — | 140 | not occurred |
| | 15 | X52 | O | 0.05 | 0.15 | 0.80 | 0.009 | 0.0010 | 0.021 | 0.0026 | — | 60 | not occurred |

Note:
*The length of the maximum B type inclusion is selected from those in the range of the wall thickness of 4 mm or less from the inner surface of the pipe.

TABLE 3

| kind of steel pipe | | strength level (API Spec.) | kind of steel | chemical composition (wt %, bal.: Fe and impurities) C | Si | Mn | P | S | Al | Ca | others | length (μm) of maximum B type inclusion* | SSC |
|---|---|---|---|---|---|---|---|---|---|---|---|---|---|
| comparative example | 1 | X65 | A | 0.05 | 0.19 | 1.26 | 0.009 | 0.0008 | 0.028 | 0.0035 | Cu:0.25, Ni:0.06 Nb:0.03, V:0.05 Ti:0.02 | 350 | occurred |
| | 2 | X65 | B | 0.06 | 0.20 | 1.28 | 0.008 | 0.0009 | 0.032 | 0.0055 | Cu:0.24, Ni:0.05 Nb:0.02, V:0.05 Ti:0.03 | 550 | occurred |
| inventive example | 3 | X65 | C | 0.05 | 0.21 | 1.26 | 0.009 | 0.0008 | 0.035 | 0.0035 | Cu:0.26, Ni:0.04 Nb:0.04, V:0.04 Ti:0.02 | 160 | not occurred |
| comparative example | 4 | X60 | D | 0.09 | 0.25 | 1.02 | 0.011 | 0.0007 | 0.026 | 0.0025 | Nb:0.04, V:0.04 Ti:0.02 | 1,000 | occurred |
| | 5 | X60 | E | 0.09 | 0.24 | 0.99 | 0.010 | 0.0008 | 0.024 | 0.0036 | Nb:0.04, V:0.06 Ti:0.03 | 300 | occurred |
| inventive example | 6 | X60 | F | 0.09 | 0.25 | 1.02 | 0.011 | 0.0007 | 0.026 | 0.0025 | Nb:0.03, V:0.05 Ti:0.03 | 220 | occurred |
| comparative ex. | 7 | X56 | G | 0.08 | 0.34 | 0.81 | 0.008 | 0.0006 | 0.41 | 0.0044 | Nb:0.05, Ti:0.02 | 600 | occurred |
| inventive ex | 8 | X56 | H | 0.08 | 0.35 | 0.82 | 0.009 | 0.0008 | 0.036 | 0.0039 | Nb:0.04, Ti:0.03 | 150 | not occurred |
| comparative ex. | 9 | X52 | I | 0.06 | 0.22 | 0.71 | 0.010 | 0.0011 | 0.036 | 0.0064 | Cu:0.23, Nb:0.02 | 300 | occurred |
| inventive | 11 | X52 | K | 0.06 | 0.22 | 0.73 | 0.009 | 0.0010 | 0.034 | 0.0045 | Cu:0.25, Nb:0.03 | 140 | not occurred |
| example | 12 | X65 | L | 0.04 | 0.15 | 1.35 | 0.007 | 0.0007 | 0.025 | 0.0021 | — | 100 | not occurred |
| | 13 | X60 | M | 0.07 | 0.22 | 1.20 | 0.009 | 0.0010 | 0.029 | 0.0032 | — | 100 | not occurred |
| | 14 | X56 | N | 0.09 | 0.26 | 0.95 | 0.008 | 0.0006 | 0.024 | 0.0024 | — | 150 | not occurred |
| | 15 | X52 | O | 0.05 | 0.15 | 0.80 | 0.009 | 0.0010 | 0.021 | 0.0026 | — | 80 | not occurred |
| | 16 | X56 | P | 0.08 | 0.34 | 0.80 | 0.008 | 0.0008 | 0.024 | 0.0048 | Nb:0.05, Ti:0.02 | 150 | not occurred |

Note:
The length of the maximum B type inclusion is selected from those in the range of the full wall thickness

What is claimed is:

1. A mechanically worked and elongated steel product having a length extending in a longitudinal direction and having sulfide cracking resistance, the product comprising a steel matrix containing B type inclusions having lengths of ≦0.20 μm in the longitudinal direction, the steel matrix consisting essentially of 0.01–0.20 wt % of carbon, 0.01–0.5 wt % of silicon, 0.3–1.8 wt % of manganese, 0.01–0.1 wt % of aluminum, ≦0.012 wt % of phosphorus, and ≦0.002 wt % of sulfur, the remainder being substantially iron and inevitable impurities, wherein a calcium/sulfur ratio is in a range of 2–10.

2. A steel product according to claim 1, wherein said B type inclusions are granular inclusions discontinuously and collectively disposed in the longitudinal direction.

3. A structure for processing petroleum products containing hydrogen sulfide, which is made of said steel product according to claim 1 or claim 2.

4. A mechanically worked and elongated steel pipe having a length extending in a longitudinal direction and having sulfide cracking resistance, the pipe comprising a steel matrix containing B type inclusions having lengths of ≦200 μm in the longitudinal direction within 4 mm of an inner surface of the pipe, the matrix consisting essentially of 0.01–0.20 wt % of carbon, 0.01–0.5 wt % of silicon, 0.3–1.8 wt % of manganese, 0.01–0.1 wt % of aluminum, ≦0.012 wt % of phosphorus, and ≦0.002 wt % of sulfur, the remainder being substantially iron and inevitable impurities, wherein a calcium/sulfur ratio is in a range of 2–10.

5. A steel pipe according to claim 4, wherein said B type inclusions are granular inclusions discontinuously and collectively disposed in the longitudinal direction.

6. A line-pipe for transporting petroleum products containing hydrogen sulfide which is made of said steel pipe according to claim 4 or claim 5.

7. A rolled steel product excellent in sulfide cracking resistance characterized in that lengths in a rolling direction of B type inclusions in a steel matrix of the product are not more than 200 μm, the steel product being made of a steel material containing 0.01–0.20 wt % of carbon, 0.01–0.5 wt % of silicon, 0.3–1.8 wt % of manganese, 0.01–0.1 wt % of aluminum, ≦0.012 wt % of phosphorus, and ≦0.002 wt % of sulfur, the remainder being substantially iron and inevitable impurities wherein a calcium/sulfur ratio is in a range of 2–10.

8. A rolled steel product according to claim 7, wherein said B type inclusions are granular inclusions discontinuously and collectively disposed in the rolling direction.

9. A structure for processing petroleum products containing hydrogen sulfide, which is made of said steel product according to claim 7 or claim 8.

10. A steel pipe excellent in sulfide cracking resistance characterized in that lengths in a rolling direction of B type inclusions in a steel matrix of the pipe within 4 mm of an inner surface of the pipe are not more than 200 μm, the steel pipe being made of a steel material containing 0.01–0.20 wt % of carbon, 0.01–0.5 wt % of silicon, 0.3–1.8 wt % of manganese, 0.01–0.1 wt % of aluminum, ≦0.012 wt % of phosphorus, and ≦0.002 wt % of sulfur, the remainder being substantially iron and inevitable impurities, wherein a calcium/sulfur ratio is in a range of 2–10.

11. A steel pipe according to claim 10, wherein said B type inclusions are granular inclusions discontinuously and collectively disposed in the rolling direction.

12. A line-pipe for transporting petroleum products containing hydrogen sulfide, which is made of said steel pipe according to claim 10 or claim 11.

* * * * *